US005292202A

United States Patent [19]

Lee

[11] Patent Number: 5,292,202

[45] Date of Patent: Mar. 8, 1994

[54] RETRACTABLE, REFILLABLE, SHARPEN-FREE PENCIL ASSEMBLY

[75] Inventor: Robert Lee, Taipei, Taiwan

[73] Assignee: Pencell Co., Ltd., Taipei, Taiwan

[21] Appl. No.: 731

[22] Filed: Jan. 5, 1993

[51] Int. Cl.[5] ..... B43K 21/16

[52] U.S. Cl. ..... 401/57; 401/90; 401/94

[58] Field of Search ..... 401/57, 62, 90, 94, 401/65

[56] References Cited

U.S. PATENT DOCUMENTS

| | | | |
|---|---|---|---|
| 1,124,786 | 1/1915 | Murchey | 401/65 |
| 4,219,282 | 8/1980 | Kuo | 401/57 |
| 4,320,982 | 3/1982 | Kuo | 401/57 |
| 4,657,421 | 4/1987 | Lin | 401/57 |
| 4,966,478 | 10/1990 | Kuo | 401/57 |

FOREIGN PATENT DOCUMENTS

| | | | |
|---|---|---|---|
| 77233 | 10/1893 | Fed. Rep. of Germany | 401/57 |
| 1232437 | 10/1960 | France . | |

*Primary Examiner*—Steven A. Bratlie

*Attorney, Agent, or Firm*—Bacon & Thomas

[57] ABSTRACT

A retractable, refillable, sharpen-free pencil assembly comprises an outer tube, an inner tube and several sections of pre-sharpened leads. The inner tube is movable relative to the outer tube. An upper half portion of the inner tube is enlarged by fitting a squeezing tube such that a spring can be positioned below the squeezing tube. When the inner tube is shifted, a lower portion of a spring pushes a lowest lead to a chucking device by which the lead is tightly gripped. A push plate attached to the slot of the outer tube has a squeezing portion engaged with the last coil of the spring. Sliding the push plate upward can pull the lower portion of the spring out of the inner tube. The propelled lead can be retracted into the inner tube and the inner tube can be pulled back and enclosed completely by the outer tube.

3 Claims, 5 Drawing Sheets

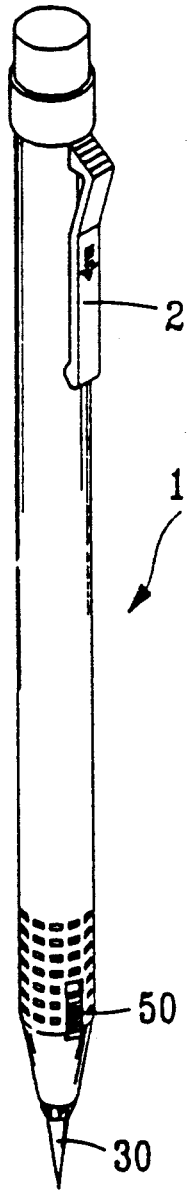
FIG. 1
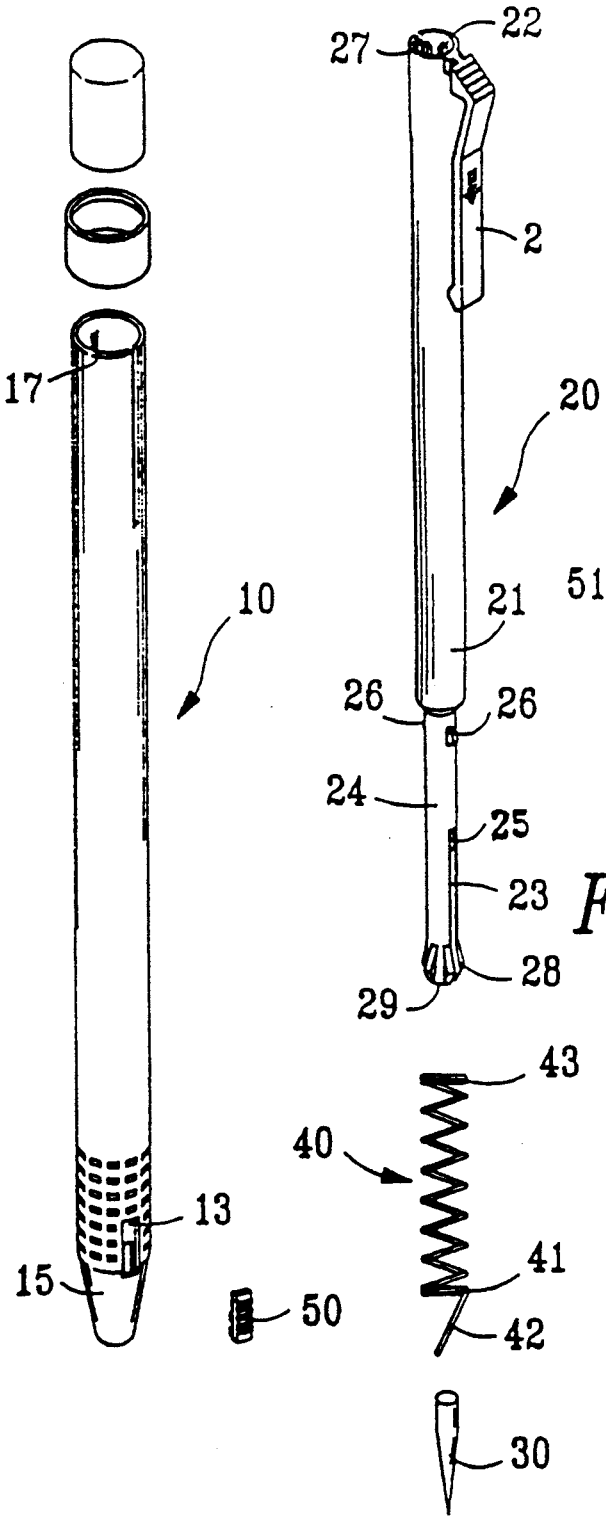
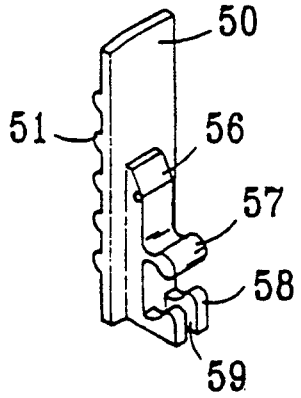
FIG. 2A
FIG. 2

RETRACTABLE, REFILLABLE, SHARPEN-FREE PENCIL ASSEMBLY

BACKGROUND OF THE INVENTION

The present invention relates to an automatic, sharpen-free pencil assembly. More specifically, the present invention relates to a retractable, refillable, sharpen-free pencil assembly.

A conventional sharpen-free pencil comprises a casing that has openings at both ends and a plurality of plastic, lead supporting members housing pre-sharpened leads. By inserting the lead supporting members into the casing, the relative movement of the members propels the lowest section of the lead forward and provides a protruding portion for writing. Since the plastic made lead supporting members occupy a certain space inside the casing, this lowers the amount of lead stored inside it. Therefore the life of the pencil is affected. In case a lead supporting member is lost, the leads cannot be propelled and the pencil set can no longer be used.

The inner tube of a conventional mechanical pencil cannot be retracted completely into the casing. In fact, known prior art arrangements do not provide for completely retracting a pre-sharpened lead into the casing. When the pencil is placed in a holder with its lead end upward, the sharpen lead may accidentally injure human bodies or eyes, raising a safety concern among users.

SUMMARY OF THE INVENTION

The principal object of the present invention is to provide a retractable, refillable, sharpen-free pencil assembly which incorporates a push plate. The push plate may be used to push one end of a spring for retracting lead. This method eliminates the tension of the spring and avoids damage to the retracting device. After the retraction, the push plate returns the spring to its ordinary position, as compared to the tension generated by a conventional spring hook device. Therefore the life of the pencil assembly can be prolonged.

Another object according to the present invention is to provide the foregoing pencil with its push plate made out of general purpose polystyrene instead of high impact polystyrene. Not only will this lower the manufacturing cost but this also permits more choices in manufacturing materials.

A further object according to present invention is to provide such a pencil in which the push plate returns to its original position after retracting the lead. Therefore the entire pencil set enhances its appearance with a one piece design. The resilient characteristic of the spring automatically encloses the inner tube into the outer tube and is no longer in contact with the lead. Therefore the life of the pencil set is greatly extended.

BRIEF DESCRIPTION OF THE DRAWINGS

The drawings disclose illustrative embodiments of the present invention that serves to exemplify the various advantages and objects hereof, and are as follows:

FIG. 1 is a perspective view of the pencil assembly according to the present invention.

FIG. 2 is a perspective fragmented view of the pencil assembly in FIG. 1 according to the present invention.

FIG. 2A is a perspective magnified back view of a push plate according to the present invention.

DETAILED DESCRIPTION OF THE REFERRED EMBODIMENT

Figure 3:
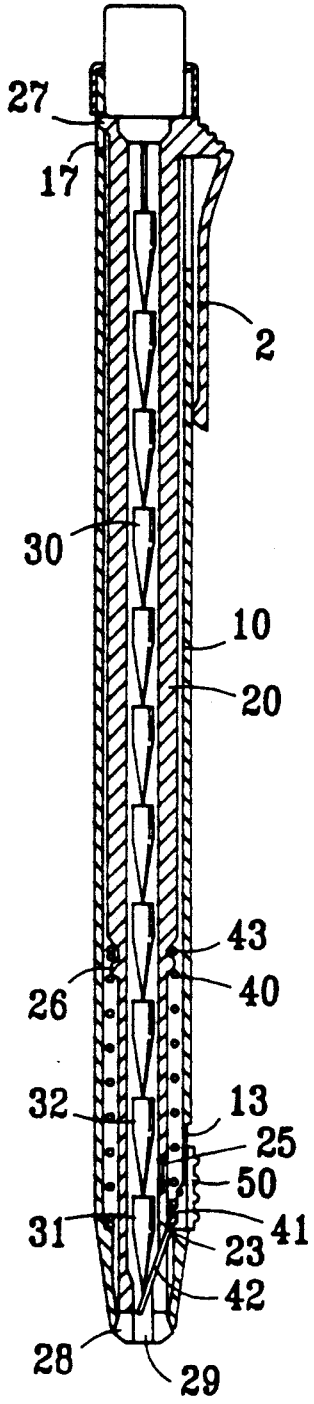
FIG. 3 is a sectional view of the assembly according to the present invention, illustrating a propelling lead when the inner tube is at its upper dead end position.

Referring to FIGS. 1 and 2, a retractable, refillable, sharpen-free pencil according to the present invention comprises an outer tube 10, an inner tube 20, several sections of leads 30, a spring 40 and a lead propelling device that consists of a push plate 50, its associated open slot 2, an enclosed slot 25 and a slot hole 13. The lower part of the inner tube 20 comprises several wedge-shaped protruded portions 28 and a reduced diameter lead hole 29 which, together with a tapered tube wall 15 in the lower portion of the outer tube 10, forms a lead chucking device.

As shown in FIG. 2A, a squeezed portion 56 in the lower portion of the main body of the push plate 50 has an upper edge portion 57 for holding a lowest coil 41 of the spring 40. Upper edge portion 57 generally has a spherical shape of a peach. The center of the lower edge portion 58 has a narrow slot 59 into which a lower portion 42 of the spring 40 extends. The push plate 50 is attached to the inside of the outer tube 10 through the slot 13 and its surface has several protruded horizontal splines or streaks 51.

During retracting, the push plate 50 is pushed upward to pull away the lower portion 42 of the spring. This temporarily limits the movement of the inner tube 20 and allows the completed retraction of the protruded portion of the lower lead 31 into the inner tube 20. On the top of the outer tube 10 is a slot 17 in which a projected portion 27 of the inner tube 20 can protrude. The upward movement of inner tube 20 is therefore limited. The projected portion 27 actually constitutes two slotted members located on top of the inner tube 20. By this construction, these slotted members serve as restraining and stabilizing elements of the inner tube 20 so that the inner tube will not pop out from the outer tube 10. As soon as the pushing force on the push plate 50 is removed, the resilient action of spring 40 retracts the inner tube 20 completely into the outer tube 10. This retraction pulls back the lower portion 42 of the spring 40 to its original position.

The outer tube 10 and the inner tube 20 can be fabricated by injection molding with general purpose polystyrene. The top half portion of the inner tube 20 has an enlarged diameter tube 21. The inner surface of tube 21 has several streaks or splines 22 located equidistantly in a longitudinal direction. The space between the streaks allows the passage of the pre-sharpened leads 30. Underneath the enlarged tube 21 is a reduced diameter tube 24. The top portion of tube 24 has two flanges 26 for squeezing the top coil of the spring 40 so that the spring may be held in a desired position (see FIGS. 3–5).

Figure 4:
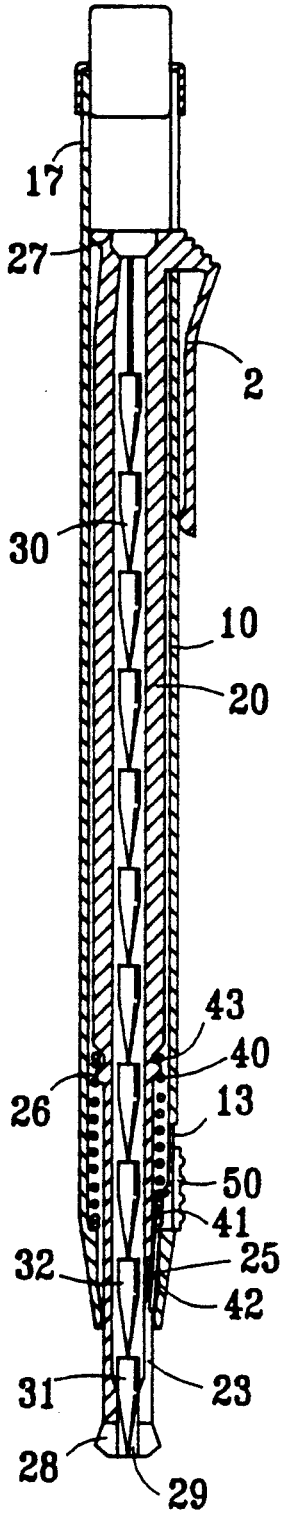
FIG. 4 is a sectional view of the assembly according to the present invention, illustrating a propelling lead when the inner tube is at its lower dead end position.
Figure 5:
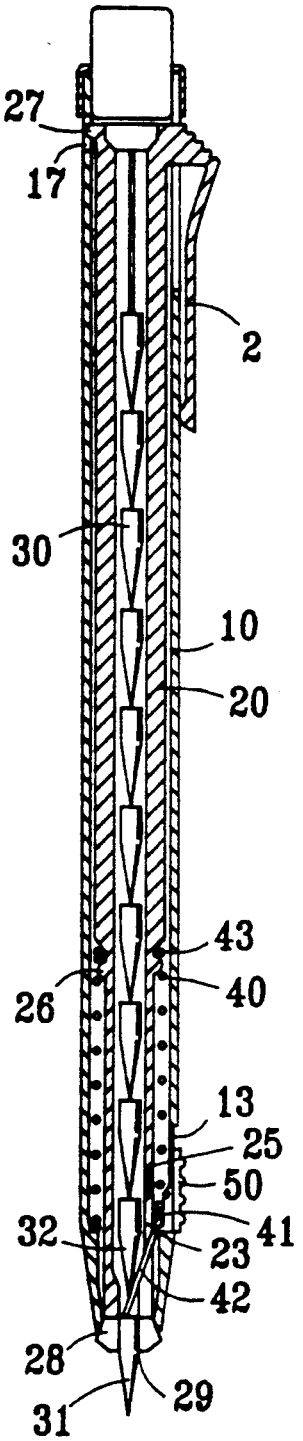
FIG. 5 is a sectional view of the assembly according to the present invention, illustrating a single section of propelling lead when the inner tube is in a writing position.
Figure 11:
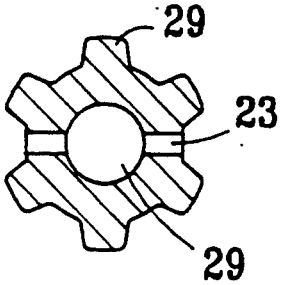
FIG. 11 is a magnified sectional view of a front part of the inner tube in FIG. 2.

Reference will now be made to FIGS. 3–5 in describing the propelling of the leads according to the present invention. The inner tube 20 is at its top dead end position due to the upward resiliency of the spring 40 in FIG. 3. The lower portion 42 of the spring 40 extends into open slot 23 such that there is a gap between the wedge-shaped protruded portions 28, and the lower portion 42 of the spring 40. Several pre-sharpened leads 30 are placed inside the inner tube 20. The reduced diameter lead hole 29 restricts the lowest lead 31 from slipping out of the inner tube 20. Only the pre-sharpened cylindrical cone portion of the lowest lead 31 is allowed to enter the lead hole 29 even as inner tube 20 is shifted downward as shown in FIG. 4 against the biasing force of spring 40. The larger diameter portion of the cylindrical cone of lead 31 remains at the top of the lead hole 29. The bottom part of the inner tube 20 actually includes a pair of symmetrical open slots 23 that make the inside diameter of the lead hole 29 flexible as best seen in FIG. 11.

In operation a user pushes the clip 2 that is attached to the inner tube 20 downward to its lowest dead end position (FIG. 4). The lower portion 42 of the spring 40 will be pushed outward, due to the restriction of the enclosed slot 25, and temporarily stays outside inner tube 20. Upon retraction of inner tube 20 relative to outer tube 10, the lower portion 42 of the spring 40 moves downward with the inner tube 20 to a position on top of the lowest lead 31 (FIG. 5). Therefore when the downward force being applied is removed, the inner tube 20 travels upward due to the resilience of the spring 40. At the same time, the lower portion 42 of the spring 40 re-enters the inner tube 20 through the open slot 23. The front part of lower portion 42 slides down with a second from the last pencil lead 32 and pushes against the top of the lowest lead 31. It further pushes a portion of the lowest lead 31 out of the lead hole 29. The larger cylindrical portion of lead 31 stays within the lead hole 29 to expand its size as well as to expand the size of the wedge-shaped protruded portion 28. The expansion enlarges the size of the open end of the retracting wall 15 of outer tube 10. Therefore the expanded wedge-shaped protruded portions 28 are blocked at the bottom openings of the outer tube 10 as the inner tube 20 is moving upward. The protruded portions remain in the writing position as shown in FIG. 5.

Figure 6:
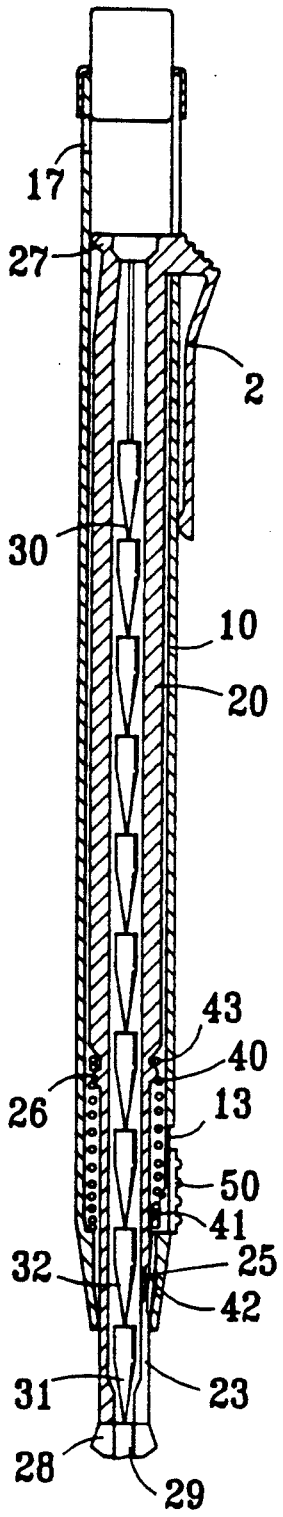
FIG. 6 is a sectional view of the assembly, illustrating when lead is being changed and the inner tube is at its lowest position according to the present invention.
Figure 7:
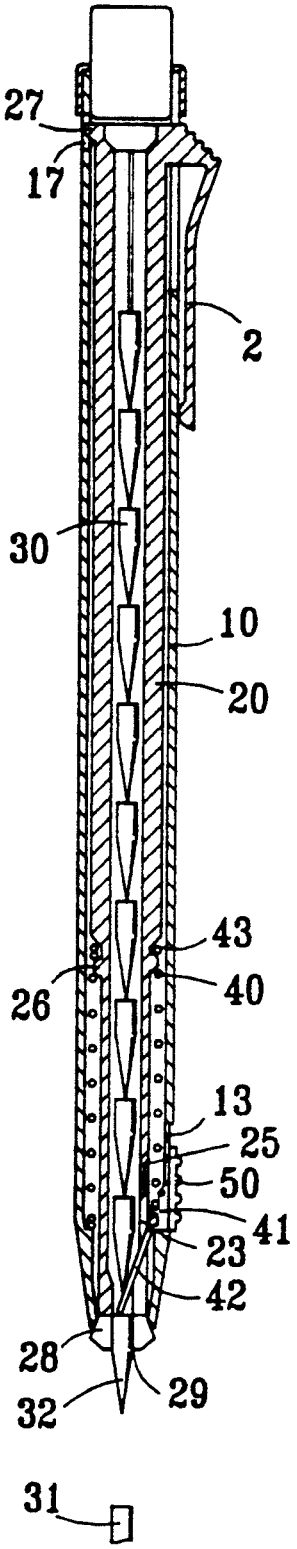
FIG. 7 is a sectional view of the assembly, illustrating replacement of lead when the inner tube is in a writing position according to the present invention.

Referring to FIGS. 6 and 7, when lead 31 becomes dull or split under the pressure of writing, a new lead 32 is required. The function of changing the lead is identical to that of propelling the lead in the manner described above and therefore it is not repeated here.

An improved portion according to the present invention that is different from the conventional technology is the use of the push plate 50. By pushing the lower portion 42 of the spring 40 for retraction purposes eliminates tension of the spring 40 completely. Furthermore the inner tube 20 may be completely enclosed by the outer tube 10 after retraction. The bottom of the inner tube 20 is on the top of the lower portion of the spring 40 so that the spring returns to its original condition.

Figure 8:
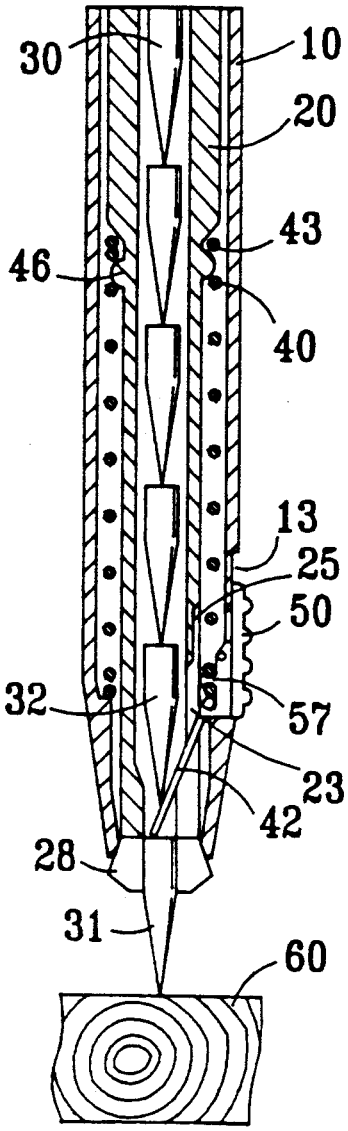
FIG. 8 is a partial sectional view of the assembly, illustrating retraction of the lead according to the present invention, in which the position of the inner tube is similar to the one in FIG. 5 except the propelled lead as shown in this drawing is ready for retraction.
Figure 9:
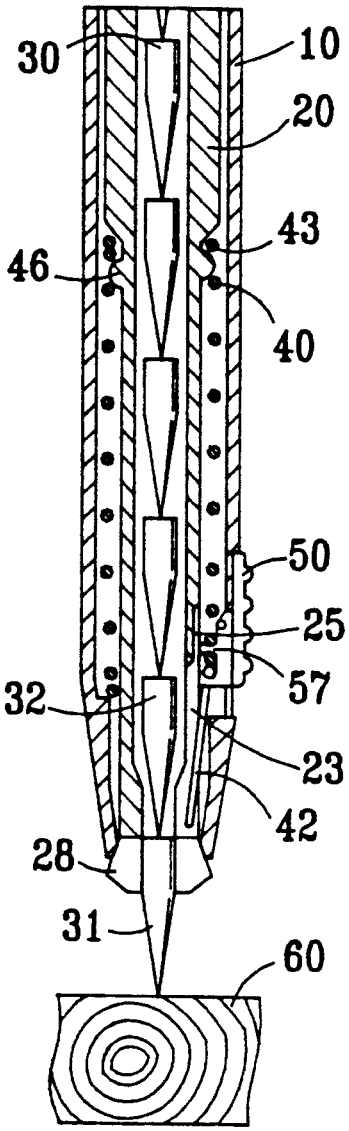
FIG. 9 is a partial sectional view of the assembly wherein the push plate has been moved upward to the top of the slot, the lower portion of the spring is disengaged from an open slot of the inner tube, the lead is no longer being squeezed and may return to the inner tube.
Figure 10:
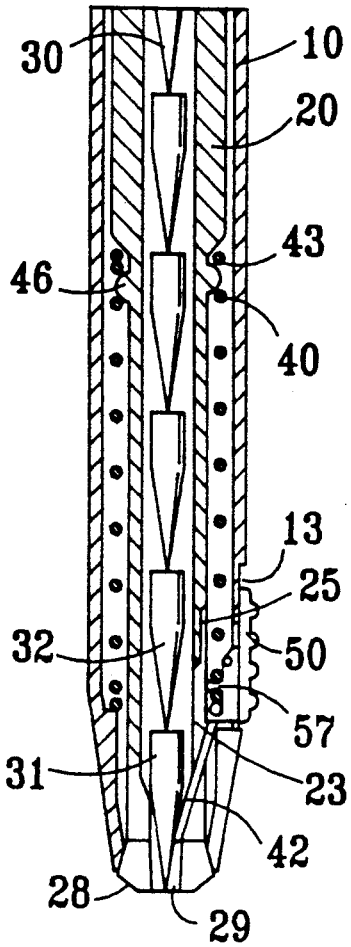
FIG. 10 is a partial sectional view of the assembly according to the present invention, in which the inner tube with the lead is enclosed by the outer tube.

Referring to FIGS. 8 and 10, when a user wants to retract the lead, the user may do so simply by pushing the push plate 50 upward. The pencil lead 31 that is in the writing position (as shown in FIG. 5) is retracted and enclosed by the inner tube 20. At the same time the inner-tube 20, as shown in its writing position in FIG. 8 is retracted and enclosed by the outer tube 10. This allows the lower portion 42 of the spring 40 to return to its original condition. The user may push the push plate 50 for retraction as shown in FIG. 9. Such pushing allows the lower portion 42 of the spring 40 to be pulled out of the open slot 23. At this time the lower portion 42 of the spring is stretched out and the inner tube 20 is restricted by the push plate 50. When the user gently presses the lead on a table or any other object, a reaction force pushes the lowest lead 31 into the inner tube 20. The user may release the push plate 50 after the lead 31 is pushed backed. Then the inner tube 20 automatically moves upward quickly due to the elasticity of the last coil 41. The inner tube 20 is not restricted by the push plate 50 during its upward movement. Because the bottom lead 31 has been retracted into the inner tube 20, only the reduced diameter cylindrical cone portion of the lead 31 stays in the lead hole 29. Moreover, due to the existence of the two symmetrical slots 23, the protruded portions 28 are compressed by the opening of the inner wall of the outer tube 10. These protruded portions 28 then retract so as to pass through the bottom opening of the outer tube 10. Finally the inner tube 20 is completely enclosed by the outer tube 10 and moves upward as shown in the upper dead end position of FIG. 3. This means that the lower portion 42 of the spring 40 will have returned to its original position underneath lead 31.

Figure 12:
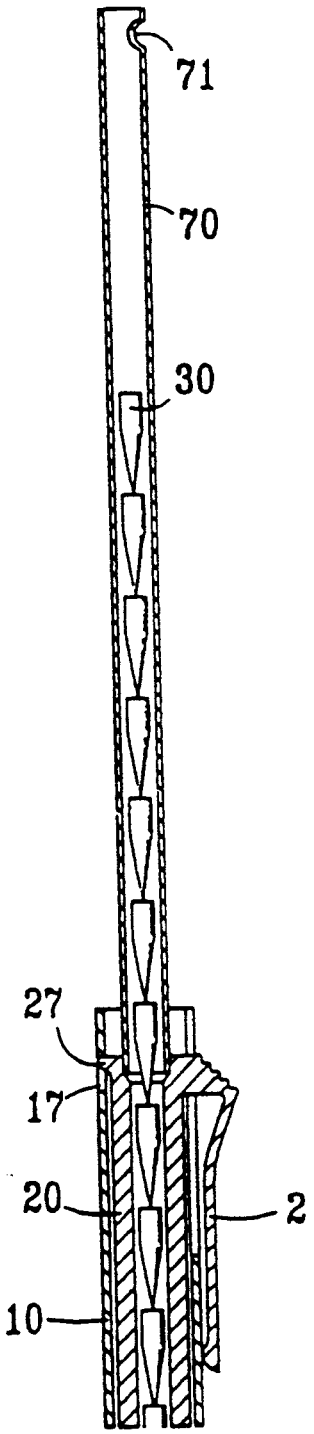
FIG. 12 is a sectional view of the spare lead holder according to the present invention, in which the new leads are being inserted into the inner tube according to the present invention.

With reference to FIG. 12, when the leads 30 in the inner tube 20 are running out, a spare lead holder 70 with several new leads 30 may be inserted into the inner tube 20 through its top lead entry hole. A cap with an eraser on top of the outer tube 10 is removed first, then the spare holder 70 is opened and the sharp ends of the leads 30 are placed downward. The opening of the spare holder 70 is placed together with the opening of the lead entry hole so that the lead will not slide out.

Figure 13:
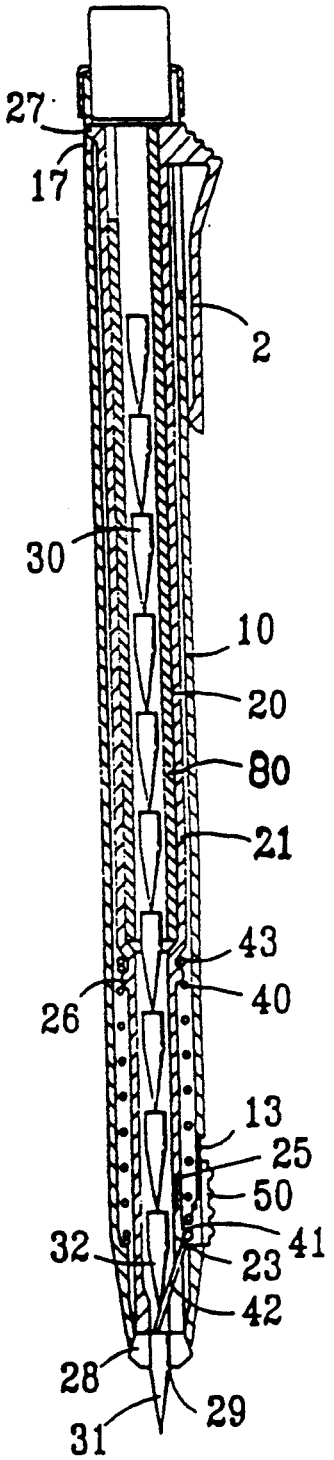
FIG. 13 is a sectional view of another embodiment of the present invention.

FIG. 13 illustrates an alternate embodiment according to the present invention. This embodiment differs from the foregoing embodiment in that a smaller squeezing tube 80 can be inserted into the inner tube 20 for the leads 30 to slide down. The size of the squeezing tube 80 shall be tightly fitted to the inner tube 20. This additional component greatly improves the manufacturing process. The squeezing tube 80 is inserted in order to ease loading of the leads.

In summary the pencil assembly according to the present invention uses a push plate to push the spring of the retracting device so as to completely retract the pencil lead. This device effectively eliminates spring tension during retraction. The inner tube, together with the pencil lead, are enclosed in the outer tube and returned to their original positions after retraction. This further extends the operational life of the pencil assembly as well as enhancing the safety. In addition, the high impact polystyrene can be replaced by general purpose polystyrene as the raw material. Not only is the manufacturing cost lower, but the manufacturing of the whole pencil assembly is no longer limited by the materials used.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

I claim:

1. A retractable, refillable, sharpen-free pencil assembly comprising:

an axially extending outer tube including an inner wall, an upper cut-out section and an open lower end, said open lower end having a reduced diameter portion and an axially extending, elongated slot defining a slotted hole portion and a closed slot portion;

an inner tube coaxially, slidably mounted within said outer tube for axial movement relative to said outer tube, said inner tube including an elongated upper section extending closely adjacent the inner wall of said outer tube and a reduced diameter lower section, said upper section carrying an actuating member that protrudes through the cut-out section of said outer tube, said reduced diameter lower section including a pair of flanges formed adjacent the upper section, an axial end portion formed with several wedge-shaped protruded portions that define a chucking device and a reduced diameter, axially extending lead hole, said wedge-shaped protruding portions having a diameter greater than the diameter of the open lower end of said outer tube, said chucking device being shiftable between a first portion adjacent a lower portion of said slotted hole portion and a second position axially spaced from the open lower end of said outer tube, said inner tube further being formed with at least one pair of axial slots extending from said chucking device along a predetermined length of said inner tube;

a plurality of pre-sharpened leads each having a cylindrical-shaped top portion and a conical bottom portion, said plurality of leads being positioned in said inner tube;

a push plate having first and second opposing sides with the first side defining a finger engaging surface and the second side carrying an upper protruding member and a pair of lower, juxtaposed protruding members, said push plate being slidably mounted in the elongated slot of said outer tube with said upper and lower protruding members extending through the slotted hole portion thereof; and a coil spring having an upper coil engaged with the pair of flanges formed on said inner tube, a lowermost coil supported by the upper protruding member of said push plate and a lower extension piece that extends between the pair of lower protruding members of said push plate, through said at least one slotted hole in said inner tube and into said chucking device, wherein said push plate is normally biased downward in the elongated slot of said outer tube and said inner tube is normally biased upward within said outer tube by said coil spring such that, in a non-use position of said pencil assembly, the lower extension piece of said coil spring extends into said chucking device and engages the conical bottom portion of a lowermost one of said plurality of pre-sharpened leads, when it is desired to position one of said plurality of pre-sharpened leads for writing, said inner tube is shifted relative to said outer tube and against the biasing force of said coil spring by means of the actuating member carried by the upper section of said inner tube such that said chucking device protrudes out of the open lower end of said outer tube while the lower extension piece of said coil spring is engaged by said inner tube and forced out of said chucking device, said inner tube is then permitted to return to its non-use position with the air of said coil spring whereupon said lower extension piece will again extend into said chucking device and will abut the cylindrical-shaped top portion of the lowermost pre-sharpened lead while said chucking device grasps said cylindrical-shaped top portion, and when it is desired to retract said lowermost pre-sharpened lead, said push plate is shifted upward within the elongated slot of said outer tube, against the biasing force of said coil spring, to cause said lower extension piece to again be retracted from within said chucking device whereby said lowermost lead will be free to shift upward within said inner tube upon the application of an upward force thereon.

2. The retractable, refillable, sharpen-free pencil assembly of claim 1, further including an additional tube located within said inner tube, said additional tube housing said plurality of pre-sharpened leads.

3. The retractable, refillable, sharpen-free pencil assembly of claim 1, wherein the elongated upper section of said inner tube includes an outer surface portion formed with a plurality of circumferentially spaced splines.

* * * * *